United States Patent [19]

Southern

[11] Patent Number: 4,834,241

[45] Date of Patent: May 30, 1989

[54] GABLE TOP PAPERBOARD CONTAINER WITH TACTILE INDICIA INDICATING OPENING SPOUT

[76] Inventor: Albert M. Southern, P.O. Box 1257, Clearwater, Fla. 34617

[21] Appl. No.: 167,921

[22] Filed: Mar. 14, 1988

Related U.S. Application Data

[63] Continuation-in-part of Ser. No. 107,335, Oct. 13, 1987.

[51] Int. Cl.[4] ..... B65D 73/00

[52] U.S. Cl. ..... 206/459; 206/621.1; 206/621.2; 206/631.3; 116/205

[58] Field of Search ..... 206/534, 459, 621.1, 206/621.2, 631.3; 229/118, 125.42; 116/205

[56] References Cited

U.S. PATENT DOCUMENTS

| | | | |
|---|---|---|---|
| 2,522,423 | 9/1950 | Youhouse | 200/167 |
| 2,523,458 | 9/1950 | Vogel | 74/553 |
| 2,721,561 | 10/1955 | Dyche | 206/459 |
| 2,751,072 | 6/1956 | Ditmar | 206/459 |
| 2,923,404 | 2/1960 | Adell | 206/459 |
| 3,339,820 | 9/1967 | Krzyzanowski | 229/17 |
| 3,349,988 | 10/1967 | Horning | 229/17 |
| 3,458,111 | 7/1969 | Leasure et al. | 206/621.2 |
| 3,498,815 | 3/1970 | Bichaylo et al. | 206/459 |
| 3,825,168 | 7/1974 | Mac Ewen | 229/17 |
| 3,924,796 | 12/1975 | Rausing et al. | 206/621.2 |
| 4,078,715 | 3/1978 | Larsson et al. | 206/621.2 |
| 4,135,316 | 1/1979 | Saito | 35/35 A |
| 4,238,541 | 12/1980 | Burton | 116/205 |
| 4,301,927 | 11/1981 | Carlsson et al. | 206/621.2 |
| 4,582,251 | 4/1986 | Odam, Jr. et al. | 236/94 |
| 4,712,690 | 12/1987 | Stohr | 206/621.2 |

FOREIGN PATENT DOCUMENTS 254614 6/1963 Australia .

*Primary Examiner*—David T. Fidei

*Attorney, Agent, or Firm*—Biebel, French & Nauman

[57] ABSTRACT

A container having a sealed gable top including top panels adapted to form a pouring spout at one end of the top. The container has a sealed ridge formed from adhered sealing panels surmounting the top panels to keep the contents of the container sealed until ready for use. The sealing panels (or one of them) are provided with tactile indicia formed therein over the top spout forming panels. The indicia may indicate the end of the top to be opened for forming the spout, and may also convey information about the contents of the container.

3 Claims, 2 Drawing Sheets

GABLE TOP PAPERBOARD CONTAINER WITH TACTILE INDICIA INDICATING OPENING SPOUT

CROSS-REFERENCE TO RELATED APPLICATION

This application is a continuation-in-part of copending application Ser. No. 107,335, filed Oct. 13, 1987, entitled "Gable Top Paperboard Container with Tactile Indicia to Indicate the Proper End to Open," now abandoned.

BACKGROUND OF THE INVENTION

This invention relates to gable top containers formed of paperboard or the like which include panels movable or extensible to form a pouring spout, and more particularly to tactile indicia on such gable to indicate the end of the gable which can open to form such a spout.

Typically, one end of the gable top is constructed in such a manner that inwardly folded and sealed end panels can be readily extensible when the seal is broken to form a pouring spout through positive outward movement of such end panels to an outwardly folded position. While panels at the other end of the gable may be opened, this is not intended and this can be done only with great difficulity and usually with accompanying tearing of gable material at such wrong end. To avoid opening the gable top at the wrong end, prior art gable type containers have visual indicia printed on the end that is desired to be opened. Words such as "open", with and without an arrow or other visual indicia, have been printed along the side of the gable adjacent the top end intended to form the spout. Such an indicia is satisfactory only under certain conditions, for example, when there is adequate light or when the user is not sight impaired; however, in the dark or being used by a sight impaired person such visible indicia is entirely inadequate. Opening the proper end becomes a hit or miss option with frequent opening of the wrong end of the container gable.

SUMMARY OF THE INVENTION

This invention provides an addition to the top edge of the gable, adjacent the end intended to be opened, of tactile indicia such that in the dark, or when used by the visually impaired, the top edge of the gable must merely be felt and the tactile indicia found for the user to know which end of the gable is intended to be opened to form the desired pouring spout. Preferably, the tactile indicia is in the form of one or more notches formed in one or both of the sealing panels which are superposed on the spout-forming panels and sealed together after the container is filled. A more complex combination of notches can also be provided to convey infomation about the contents of the container. This indicia can be formed with little additional expense in the container panels at the time the container is blanked from suitable paperboard stock, and will not interfere with the construction and function of the panels. Thus, the considerable advantages of the invention are attainable at minimal cost to the manufacturer, yet with maximum convenience to many users of products packed in such containers.

The principal object of the invention, therefore, is to provide tactile indicia indicating the location of the opening structure on gable top paperboard containers and the like; to provide such indicia in the form of notches which are easily formed in the blank from which the container is formed, and which do not require any major change in the panel structure of the container or the manner in which it is assembled, filled, and sealed; and to provide if desired more complex indicia of this type which can convey further information about the container or its contents.

Other objects and advantages of the invention will be apparent from the following description, the accompanying drawings and the appended claims.

DESCRIPTION OF THE PREFERRED EMBODIMENT

Figure 1:
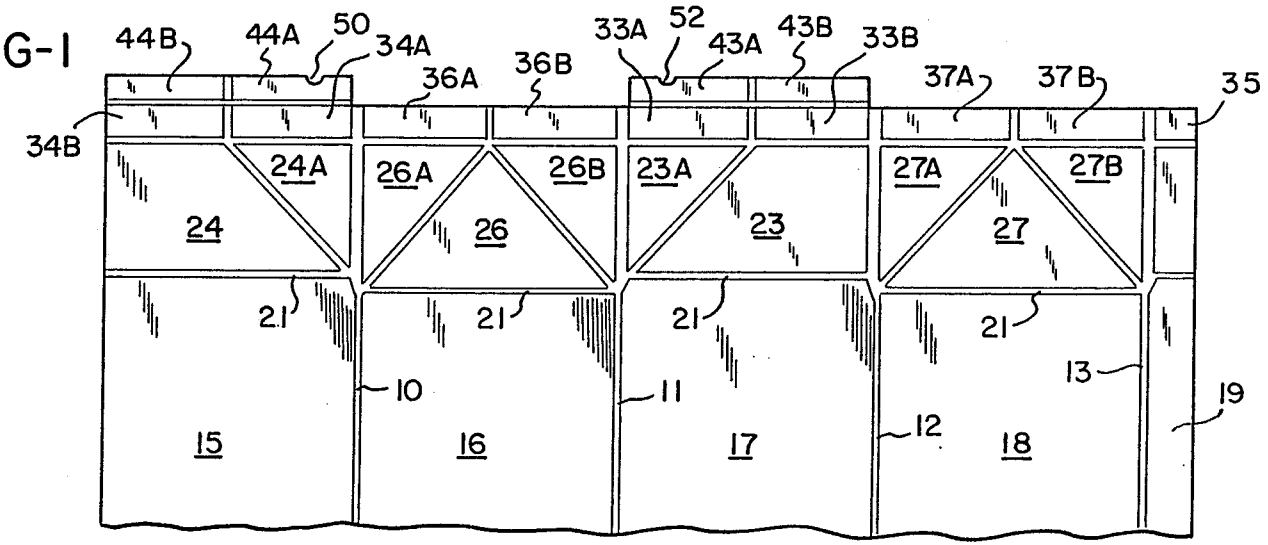
FIG. 1 is an enlarged fragmentary view of the portion of the gable top panels of the container blank, illustrating the location and nature of a preferred embodiment.
Figure 2:
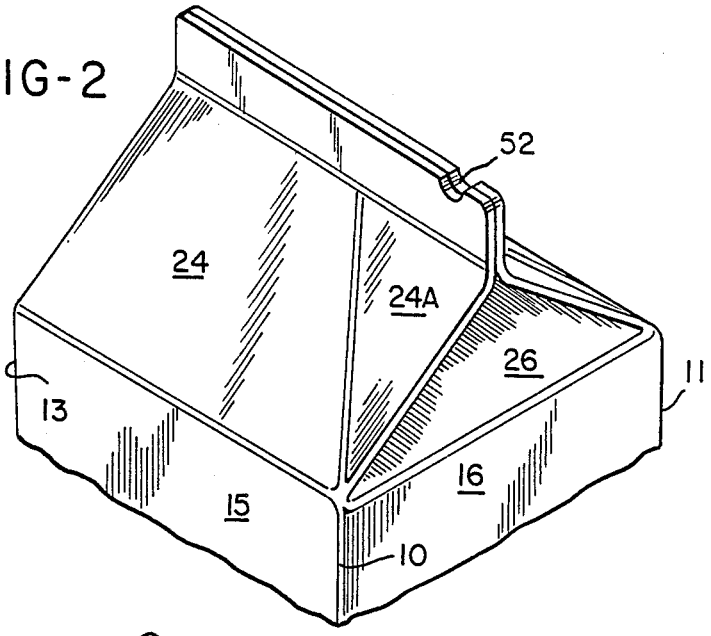
FIG. 2 is a partial perspective view of a sealed container top incorporating the invention.
Figure 3:
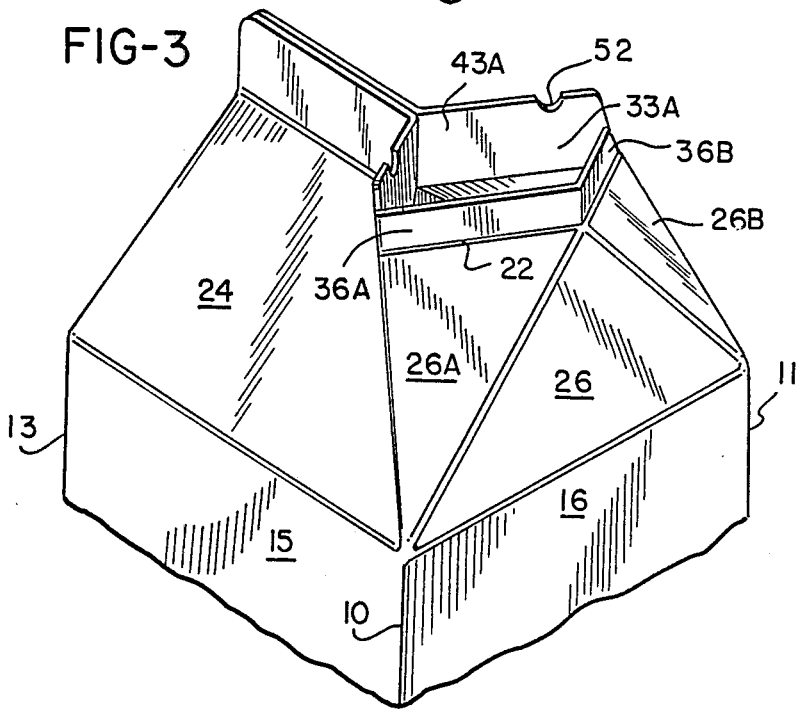
FIG. 3 is a view similar to FIG. 2, with the top open and the pouring spout extended.

FIGS. 1–3 show a gable top type of coated paperboard container widely used for packaging of edible liquids such as milk, fruit juices and the like, or in some cases for certain other pourable materials, such as powders. The container is formed of a paperboard blank which is divided in conventional fashion by fold or crease lines 10, 11, 12 and 13 into the main body panels of the carton, indicated as the rear panel 15, one side panel 16 above which the opening and spout is located, a front panel 17, the opposite side panel 18 and a flap 19 which is adhered to the panel 15 in the completed carton.

Above the front and rear panels are corresponding front and rear top panels 23 and 24, and above the side panels are the top side or gable panels 26 and 27, which are generally formed as approximately equilateral trianglular members, each having subordinate top end panels 26A and 26B on either side of panel 26, and 27A and 27B in the same relationship. The top end panels 26, 26A and 26B are intended to form the opening and pouring spout, and on either side of them, as part of the top front and rear panels, there are inverted right-triangular panels 23A and 24A, which accomodate the movement of the panels 26, 26A and 26B between open and closed positions, as later described. Above the array of top panels there are corresponding sealing panels which are divided by score lines into upper and lower sections, and in the case of the front and back also into upper and lower sections.

Thus, over the rear top panel 24 there are lower sealing panels 34A and 34B, and upper sealing panels 44A and 44B. Over top end panel 26A and 26B there are lower sealing panels 36A and 36B. Above the top front panel 23 and 23A there are lower sealing panels 33A and 33B, and upper sealing panels 43A and 43B. Over the other top side panels 27A and 27B there are lower sealing panels 37A and 37B. Above the top flap 25 there is a sealing flap 35.

When the carton is filled, the triangular top end panels 26 and 27 are folded inward over the top of the carton, bringing the sealing panels into contact with each other. The end sealing panels 36A and 36B are folded together within the front and back sealing panels 34A and 33A, and the end sealing panels 37A and 37B are likewise folded together and within sealing panels 33B, 34B and flap 35. The upper sealing panels 44B and 44A are brought into facing contact with upper sealing panels 43A and 43B, and all of these upper sealing panels are adhered together to form a liquid tight gable top closure for the filled carton. When so adhered, the sealing panels surmount the top of the container and form a narrow ridge, exending from one end to the other of the top structure.

The upper sealing panels 44A and 43A are provided with an adhesive connection which is intended to be parted by force directed to pull these panels apart. In so doing, the panels 26A and 26B fold outward around their respective connections with the other top panels and the panel 26 swings outward of the carton top, to the position shown in FIG. 3. The other side of the gable top construction is designed to remain firmly adhered, although it is possible to pull it apart with considerable force, and the three panels 26, 26A and 26B function as spout forming panels which make a retractable pouring spout while the carton remains in use. All of the foregoing structure is per se known in the prior art.

When such a container or carton is to be opened under poor lighting conditions, or used by a person having impaired eyesight, it is practically impossible to discriminate between the end of the gable top intended to be so opened, and the other end which is intended to remain intact. Customarily the word "OPEN" is printed on or near the gable end panels 23A and 24A, and an arrow or the like may also be printed to indicate which gable end is to be opened. However this is of no practical use to the sight impaired, or in poor ambient light.

In accordance with the invention, tactile indicia is provided on the gable end to be opened, preferably by forming a notch, or series of notches or the like on one or both of the sealing panels 43A or 44A. This identifies to the touch the sealing panels which should be separated for proper opening and subsequent usage of the carton. An important advantage of such indicia is that it can be formed at minimal cost, simply by die cutting the notch or notches as shown at 50 and 52 in FIG. 1 when the carton is blanked from a sheet of carton stock. Thus, the tactile indicia can be added to cartons at practically no cost to the manufacturer. Even after the carton is opened, the tactile indicia can again be used to tell which end is to be reopened for further use.

Figure 4:
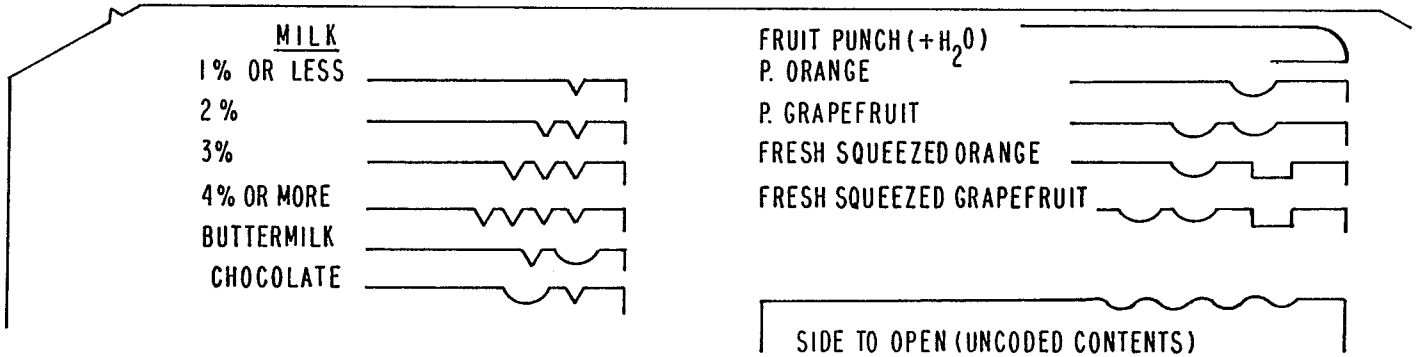
FIG. 4 is an illustration of the manner in which the invention may be extended to indicate in code form information about the container and/or its contents.

FIG. 4 illustrates various expansion of the tactile indicia to convey further information about the contents of the containers. In the case of milk cartons, a single V-notch can indicate milk with butterfat content of 1% or less; two V-notches can indicate 2% butterfat, etc., and combinations of V-notches and U-notches can indicate buttermilk or chocolate flavored milk. Similar code combinations are illustrated to give tactile identification to various types of pure or mixed citrus drink, and a wavelike formation can indicate merely the side of the gable top to be opened, and that the contents are not identified (uncoded). In this scheme, the single U-shaped notch shown in FIGS. 2 and 3 would indicate a container of orange drink (orange juice/water solution) as opposed to pure orange juice which would have a different code as shown.

Each of these unique tactile codes can easily be added to the container or carton blanks, thus the present invention can cenvey substantial tactile information at litle cost, and can provide enhanced utility to the containers.

While the products herein described constitute preferred embodiments of the invention, it is to be understood that the invention is not limited to these precise products, and that changes may be made therein without departing from the scope of the invention which is defined in the appended claims.

What is claimed is:

1. A container formed of paperboard and having a top comprised of plurality of panels at one end of said top including a gable panel and a pair of top panels connected to opposite sides of said gable panel and cooperating to form a gable end construction at said one end of said top adapted to be opened into a pouring spout, said top also including sealing panels adhered to each other and extending from and overlying said gable panel and top end panels, some of said sealing panels being adhered to one another to form, when separated said pouring spout, while others being firmly adhered, said adhered sealing panels attached to said top panels by a fold line having tactile indicia means in the form of at least one notch on at least one of opposing adhered sealing panels spaced toward said one end of said top from the apex of said gable panel to differentiate by touch the opening and spout forming one end from the opposite end of said top whereby one side of said top end can be identified by touch with said tactile indicia means remaining as part of said container after said container is opened

2. In a paperboard container formed from a blank having a multiplicity of interconnected panels assembled to the form of a gable top carton, said carton having a generally rectangular body surmounted by a top comprising a plurality of panels extending upward from said body including an inwardly inclined gable panel and at least a pair of top panels connected to opposite sides of said gable panel and to said body and cooperating to form a gable end construction adapted to be opened into a pouring spout the top of said gable end being formed with a sealed ridge made from sealing panels attached to said top panels and adhered to each other an overlying and closing said top panels, some of said sealing panels attached to said top panels by a fold line and being adapted to be separated to break the sealed ridge and to allow said top panels to fold outward of the gable top, while others of said sealing panels being firmly adhered to one another the improvement comprising said ridge having therein tactile indicia means in the form one of at least one notch formed from the material of at least one of said sealing panels adapted to be separated and located above said gable panel to differentiate the opening and spout forming end from the opposite end of the gable top, whereby the opening and pouring spout end can be identified by touch with said tactile indicia means remaining as part of said container after said container is opened.

3. A container according to claim 2 wherein said tactile indicia means conveys information about the contents of said container.

* * * * *